US011067939B2

(12) United States Patent
Tagansky et al.

(10) Patent No.: US 11,067,939 B2
(45) Date of Patent: Jul. 20, 2021

(54) MAINTAINING LAYER OF CLEANING SOLUTION ON PHOTOCONDUCTIVE SURFACE VIA WIPER WITH PURPOSEFULLY ROUNDED EDGE

(71) Applicant: HP INDIGO B.V., Amstelveen (NL)

(72) Inventors: Boaz Tagansky, Rishon Letzion (IL); Shahar Tal, Ness Ziona (IL); Sasi Moalem, Ness Ziona (IL); Reut Diamant, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 7 days.

(21) Appl. No.: 15/569,241

(22) PCT Filed: Jul. 31, 2015

(86) PCT No.: PCT/EP2015/067641
§ 371 (c)(1),
(2) Date: Oct. 25, 2017

(87) PCT Pub. No.: WO2017/020924
PCT Pub. Date: Feb. 9, 2017

(65) Prior Publication Data

US 2018/0321629 A1 Nov. 8, 2018

(51) Int. Cl.
*G03G 21/00* (2006.01)

(52) U.S. Cl.
CPC ..... *G03G 21/0017* (2013.01); *G03G 21/0011* (2013.01); *G03G 21/0076* (2013.01); *G03G 21/0088* (2013.01); *G03G 21/0094* (2013.01); *G03G 2221/001* (2013.01); *G03G 2221/0084* (2013.01)

(58) Field of Classification Search
CPC ..... G03G 21/0017; G03G 21/0076; G03G 21/0094; G03G 2221/001; G03G 2221/0084; G03G 21/0011; G03G 21/0088
See application file for complete search history.

(56) References Cited

U.S. PATENT DOCUMENTS 5,097,294 A 3/1992 Nishio et al.
5,218,412 A * 6/1993 Martin ..... G03G 21/0029 15/256.5
5,596,398 A * 1/1997 Woo ..... G03G 21/0088 399/346

(Continued)

FOREIGN PATENT DOCUMENTS

CN 88102674 11/1988
CN 1065939 11/1992

(Continued)

OTHER PUBLICATIONS

English machine translation of Azuma (JP H04-287081 A).*

(Continued)

*Primary Examiner* — Walter L Lindsay, Jr.
*Assistant Examiner* — Geoffrey T Evans
(74) *Attorney, Agent, or Firm* — Michael A Dryja

(57) ABSTRACT

A cleaning solution is used to at least substantially remove colorant from the photoconductive drum as the photoconductive drum rotates. A wiper wipes the cleaning solution from the photoconductive drum while purposefully maintaining a layer of the cleaning solution on the drum. The wiper has an edge that is purposefully rounded.

17 Claims, 3 Drawing Sheets

(56) References Cited

U.S. PATENT DOCUMENTS

| | | | | |
|---|---|---|---|---|
| 5,599,393 | A * | 2/1997 | Elvidge | D21H 25/12 118/117 |
| 5,867,758 | A | 2/1999 | Yoshida et al. | |
| 6,021,297 | A | 2/2000 | Campbell et al. | |
| 6,308,034 | B1 * | 10/2001 | Nakashima | G03G 15/105 399/249 |
| 7,048,969 | B2 * | 5/2006 | Ichikawa | B05C 1/0813 118/110 |
| 8,086,133 | B2 | 12/2011 | Ziegelmuller et al. | |
| 2005/0201785 | A1 * | 9/2005 | Gila | G03G 15/161 399/348 |
| 2012/0207508 | A1 | 8/2012 | Nishiyama et al. | |
| 2012/0237272 | A1 * | 9/2012 | Sandler | G03G 15/10 399/302 |
| 2012/0275836 | A1 | 11/2012 | Kadis | |
| 2013/0259551 | A1 * | 10/2013 | Liu | G03G 21/0094 399/346 |
| 2014/0141361 | A1 * | 5/2014 | Liu | G03G 5/14721 430/56 |

FOREIGN PATENT DOCUMENTS

| | | | |
|---|---|---|---|
| CN | 1152731 | 6/1997 | |
| CN | 1279708 | 1/2001 | |
| CN | 101303563 | 11/2008 | |
| CN | 101414149 | 4/2009 | |
| CN | 102129195 | 7/2011 | |
| CN | 102648440 | 8/2012 | |
| CN | 103324069 | 9/2013 | |
| CN | 103365127 | 10/2013 | |
| DE | 102009026495 A1 * | 12/2010 | B05C 11/025 |
| JP | H04287081 | 10/1992 | |
| JP | 2001154553 | 6/2001 | |
| JP | 2002132106 | 5/2002 | |
| WO | WO-8912260 | 12/1989 | |
| WO | WO-2012019755 A1 * | 2/2012 | B05C 11/025 |

OTHER PUBLICATIONS

English machine translation of Miyamori et al. (JP 2001-154553 A).*

English machine translation of Fujishima et al. (JP 2002-132106 A).*

English machine translation of Kuhn et al. (DE 102009026495 A1) (Year: 2010).*

Unknown, "Canon LBP-LX (EPL) & FX-1 Toner Cartridges", Summiy Technologies, Sep. 28, 2007, 6 pages.

* cited by examiner

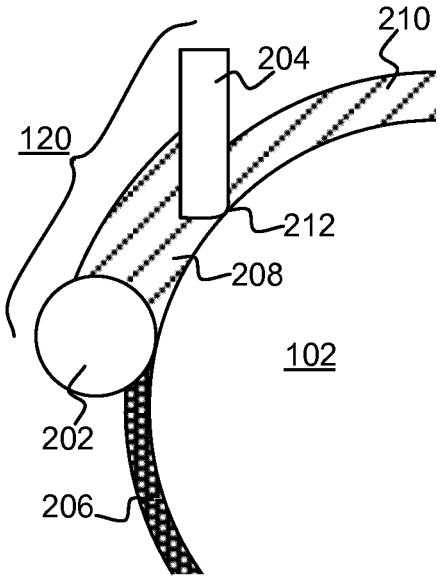
FIG 2
FIG 3
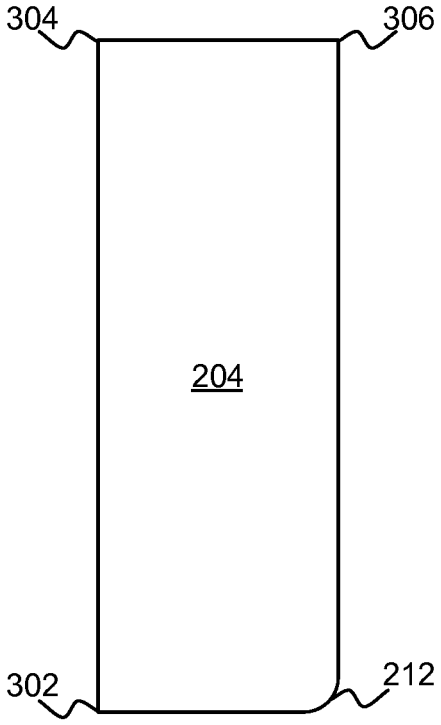
FIG 4
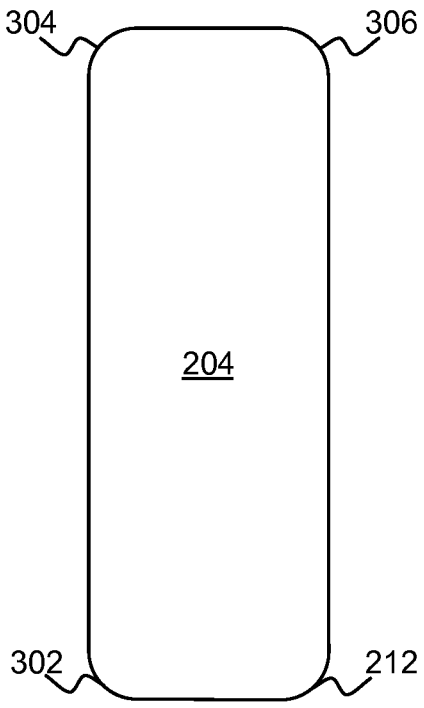

MAINTAINING LAYER OF CLEANING SOLUTION ON PHOTOCONDUCTIVE SURFACE VIA WIPER WITH PURPOSEFULLY ROUNDED EDGE

BACKGROUND

Electrophotographic printing devices, such as laser printing devices, form images on media like paper. In general, a photoconductive drum is charged over its entire surface, and then selectively discharged in accordance with the image to be formed. Charged colorant such as dry or liquid ink or toner adheres to locations on the drum that have been discharged, and the colorant is then directly or indirectly transferred from the drum to the media. The photoconductive drum is discharged and remaining colorant on the drum is removed before repeating the image-formation process.

BRIEF DESCRIPTION OF THE DRAWINGS

FIG. 2 is a diagram of an example cleaning assembly of an electrophotographic printing device.

FIG. 3 is a diagram of an example wiper of a cleaning assembly of an electrophotographic printing device to assist cleaning of the photoconductive drum of the device.

FIG. 4 is a diagram of another example wiper of a cleaning assembly of an electrophotographic printing device to assist cleaning of the photoconductive drum of the device.

DETAILED DESCRIPTION

Figure 1:
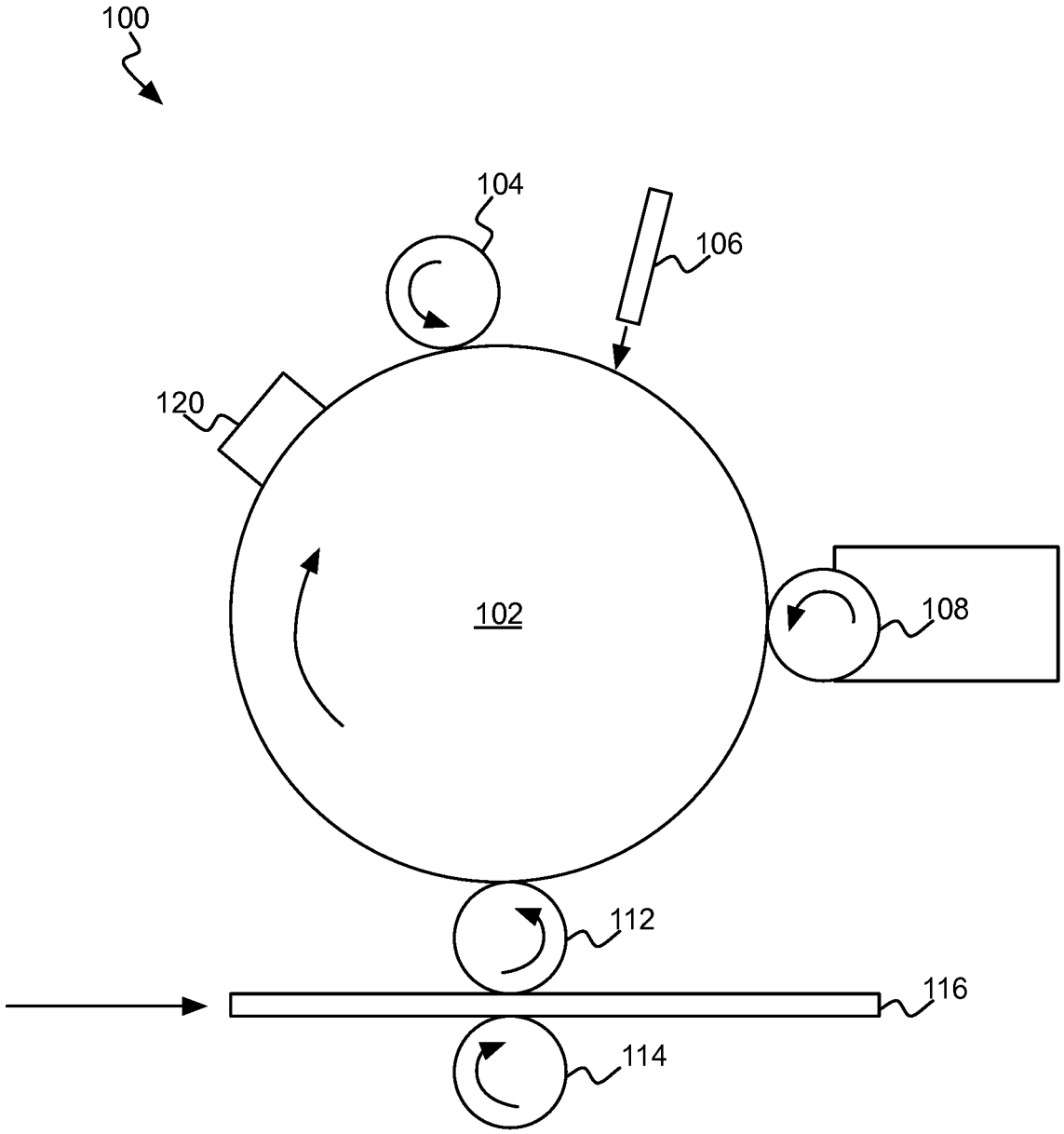
FIG. 1 is a diagram of an example electrophotographic printing device.

As noted in the background section, in an electrophotographic printing device, a photoconductive drum is used to transfer colorant onto media to form images on the media. Photoconductive drums can be fabricated from a variety of different materials. Some materials have relatively short lifespans; for example, organic photoconductive foil drums may have a lifetime of about 100,000 image-forming impressions. Other materials can have much longer lifespans; for example, amorphous silicon photoconductive drums may have a lifetime greater than 1,000,000 image-forming impressions.

A drawback to using photoconductive drums having greater longevity is that their ability to form images on media without impairing image-formation quality is degraded. Specifically, dirt, debris, and other contaminants may over time stick to the drum. As the photoconductive drum ages, a sufficient amount of such contaminants stick to the drum to visibly affect image-formation quality. That is, undesired artifacts such as dark specks and marks may be visually evident on the media on which images are formed, and/or blank spots where colorant should have been deposited but has not been may become visually evident on such media.

As noted in the background section, after colorant has been transferred to media, the photoconductive drum is discharged and remaining colorant removed before the image-formation process is repeated. Removal of the colorant is achieved by rotating the drum against a sponge impregnated with a cleaning solution or fluid. The photoconductive drum is then rotated against a wiper to remove the cleaning solution from the drum before the image-formation process is repeated. Conventionally, designers of electrophotographic printing devices have sought to maximize the extent to which the cleaning solution is removed by the wiper. In actuality a small amount of cleaning solution typically remains after wiping, on the order of tens of nanometers in thickness, although this has not been seen as desirable.

The inventors have unintuitively discovered that purposefully maintaining a relatively tick layer of cleaning solution on the photoconductive drum, on the order of hundreds of nanometers in thickness, maintains the ability of photoconductive drums to form images on media without impairing image-formation quality over a longer time period. Amorphous silicon photoconductive drums and other types of photoconductive drums that have lifespans greater than 1,000,000 image-forming impressions can still form images without quality impairment even as they approach the end of their lifespans. Purposefully maintaining a relatively thick layer of cleaning solution on the photoconductive drum is to great degree illogical, insofar as the inclusion of a wiper within an electrophotographic printing device is conventionally meant to remove the solution from the drum to the greatest degree possible.

Disclosed herein are elegant techniques for purposefully maintaining a cleaning solution layer on the photoconductive drum to promote the longevity of the drum's ability to form images on media without degradation in image quality. The inventors have discovered, for instance, that purposefully rounding the edge of the wiper that comes into contact with the photoconductive drum maintains a layer of cleaning solution on the drum greater than one-hundred nanometers in thickness during wiping. By comparison, typically the wiper has at least a nominally sharp edge to maximize cleaning solution removal from the drum, such that the amount that remains after wiping is on the order of tens of nanometers in thickness.

The thickness of the cleaning solution layer maintained on photoconductive drum during wiping is generally great enough to promote longevity of the drum's ability to form images on media without image quality degradation, but not great enough to interfere with charging of the drum at the beginning of the image-formation process. That is, too thick of a layer of cleaning solution remaining on the photoconductive drum can result in an insulating layer that prevents the charger roller, corona wire, or other charging mechanism from uniformly charging the surface of the drum before being selectively discharged in correspondence with the image to be formed on the media. This is another reason why typically wipers have had nominally sharp edges to maximize removal of the cleaning solution from the photoconductive drum.

Purposefully maintaining a relatively thick cleaning solution layer on the photoconductive drum has other advantages as well. Besides promoting the longevity of the drum's ability to form images on media without image quality impairment, a relatively thick cleaning solution layer can protect the surface of the photoconductive drum itself from becoming damaged by contaminants like dirt and debris. The contaminants are less likely to become lodged into the drum's surface when a relatively thick layer of cleaning solution coats the photoconductive drum, and such contaminants are more likely to be removed the next time the drum rotates past the sponge or wiper. Furthermore, a relatively thick cleaning solution layer on the photoconductive drum can protect the drum when it is being charged; the charging process subjects the photoconductive drum to harsh conditions in which ozone can be present and in which the drum is bombarded with electrons.

FIG. 1 shows an example electrophotographic printing device 100. Cylindrical components, such as rollers, of the device 100 rotate in the directions indicated by their arrows. A photoconductive drum 102, which may also be referred to as a cylinder, rotates to receive a charge transferred by a rotating charge roller 104, which is more generally a charging mechanism, across its photoconductive surface. The photoconductive drum 102 may be an organic photoconductive foil drum, an amorphous silicon photoconductive drum, or another type of photoconductive drum.

An optical discharge mechanism 106, such as a laser, selectively discharges the photoconductive drum 102 in accordance with an image to be formed onto media 116, such as paper, as the drum 102 continues to rotate. In one implementation, at least one rotating dispensing roller 108 transfers colorant, such as dry or liquid ink or toner, to the photoconductive drum 102 as the drum 102 continues to rotate. The colorant is deposited onto the photoconductive drum 102 typically just where the drum 102 has been discharged, and thus in accordance with the image to be formed. The term colorant is not used herein to imply that the ink, toner, or other colorant is of a particular color, and indeed the colorant can be black.

As the photoconductive drum 102 continues to rotate with the selectively transferred colorant thereon, a rotating transfer roller 112 in one implementation transfers the colorant from the drum 102 onto the media 116 that is advancing from left to right between the transfer roller 112 and a rotating impression roller 114. In another implementation, the drum 102 transfers the colorant directly onto the media 116. The photoconductive drum 102 rotates past a cleaning assembly 120 to completely discharge its photoconductive surface and remove any colorant still thereon before repeating the described process via being charged by the charge roller 104.

FIG. 2 shows an example cleaning assembly 120 of the electrophotographic printing device 100. The cleaning assembly 120 includes a sponge, or cleaning mechanism, 202, and a wiper, or wiping mechanism, 204. In relation to FIG. 1, the sponge 202 is positioned before the wiper 204 with respect to the rotational direction of the photoconductive drum 102, and the wiper 204 is positioned before the charge roller 104 with respect to the rotational direction of the drum 102. As the photoconductive drum 102 of the electrophotographic printing device 100 rotates towards the sponge 202, colorant 206 may remain on the drum 102, which the cleaning assembly 120 at least substantially removes or cleans from the drum 102.

The sponge 202 is impregnated with a cleaning solution or fluid, such as isoparaffinic fluid, and can be in physical contact with the photoconductive drum 102. The sponge 202 may, for instance, by in fluidic contact with a supply of the cleaning solution that replenishes the sponge 202 and keeps the sponge 202 continuously moist with the solution. As the photoconductive drum 102 rotates past the sponge 202, the physical interaction between the sponge 202 and the drum 102, and/or the physical and/or chemical interaction between the cleaning fluid and the drum 102, cleans or removes any colorant 206 remaining on the drum 102. Once the photoconductive drum 102 has rotated past the sponge 202, a thick layer 208 of the cleaning solution remains on the drum 102.

As the photoconductive drum 102 rotates past the wiper 204, an edge 212 of the wiper 204 that is closest to the drum 102, and which can be in contact with the drum 102, wipes the cleaning solution from the drum 102. However, in actuality, a layer 210 of the cleaning solution remains on the photoconductive drum 102 after the drum 102 has rotated past the wiper 204. The thickness of the layer 210 of the cleaning solution that remains on the drum 102 after rotating past the wiper 204 is less than the thickness of the layer 208 that remains before rotating past the wiper 204. However, the thickness of the cleaning solution layer 210 is still relatively thick, and is greater than the thickness of a layer of cleaning solution that would otherwise remain if maximal removal of the cleaning solution by the wiper 204 were desired.

Stated another way, the wiper 204 wipes the cleaning solution from the photoconductive drum 102 while purposefully maintaining the layer 210 of the cleaning solution on the drum 102. The cleaning solution layer 210 may have a thickness greater than 100 nanometers, and even greater than 300 nanometers, as opposed to a thickness on the order of tens of nanometers if maximal clean solution removal were desired. The cleaning solution layer 210 that is purposefully kept on the photoconductive drum 102 more generally has a thickness sufficient to promote the longevity of the drum's 102 ability to form images on media without impairing image-formation quality, and to promote the longevity of the photoconductive drum 102 itself.

FIGS. 3 and 4 show an example wiper 204 of the cleaning assembly 120 of the electrophotographic printing device 100. In both FIGS. 3 and 4, the edge 212 of the wiper 204 that is closest to the photoconductive drum 102 in FIG. 2 is purposefully rounded, curved, or non-nominally sharp. Purposefully rounding the edge 212 increases the thickness of the cleaning solution layer 210 that remains after the photoconductive drum 102 rotates past the wiper 204. As depicted in FIGS. 3 and 4, the rounded edge 212 can be semi-circular.

For example, when the edge 212 of the wiper 204 has a radius of 1.5 millimeters, the cleaning solution layer 210 that remains on the photoconductive drum 102 after rotating past the wiper 204 in FIG. 2 can be about 300 nanometers in thickness. In general, the edge 212 may have a radius between 1.5 millimeters and 10.0 millimeters, or even more generally, between 0.1 millimeters and 100 millimeters. A radius within this range may maintain a sufficiently thick cleaning solution 210 on the photoconductive drum 102 during wiping by the wiper 204 to promote longevity of the drum 102's ability to form images without impairing quality and longevity of the drum 102 itself while not being so great as to interfere with charging of the drum 102 by the charge roller 104 of FIG. 1.

In FIG. 3, just the edge 212 of the wiper 204 that is closest to the photoconductive drum 102 in FIG. 2 is purposefully rounded, curved, or non-nominally sharp. Other edges 302, 304, and 306 of the wiper 204, by comparison, can remain nominally sharp because they are not in contact with the photoconductive drum 102. By comparison, in FIG. 4 the edges 302, 304, and 306 of the wiper 204 are also rounded, curved, or non-nominally sharp, like the edge 212. This is because the wiper 204 may be removably positionable in relation to the photoconductive drum 102. When the edge 212 wears out over time, for instance, the wiper 204 may be repositioned so that another edge 302, 304, or 306 becomes closest to the photoconductive drum 102.

Figure 5:
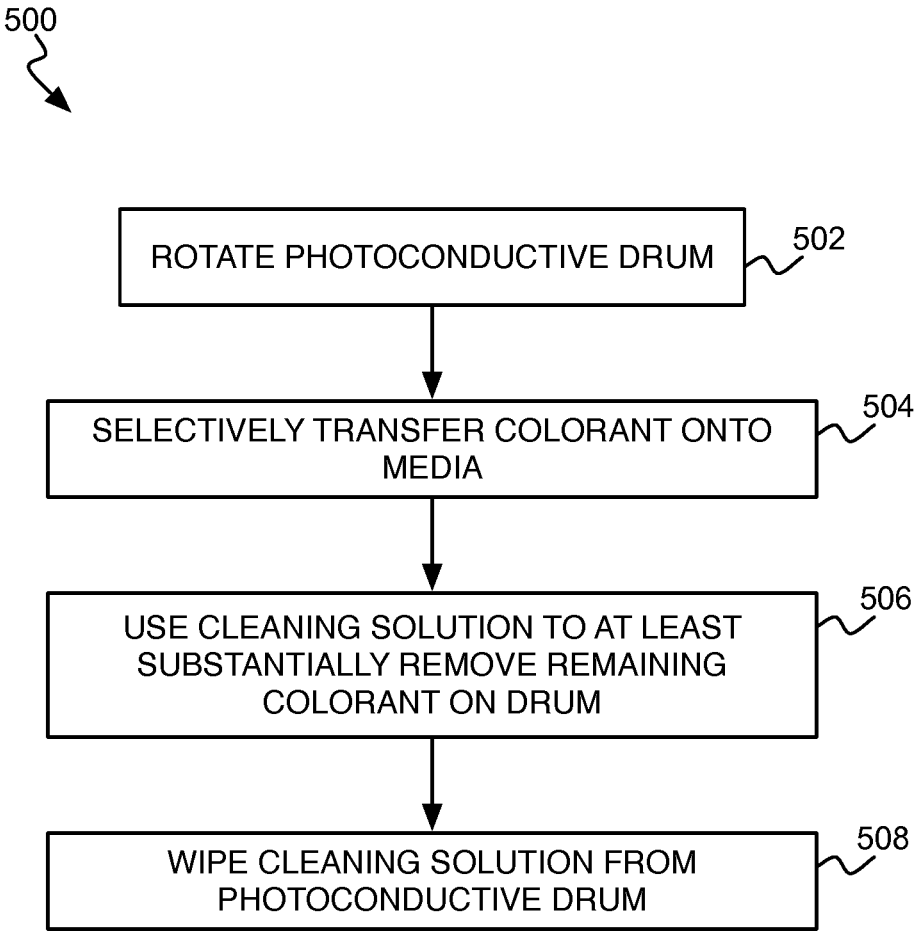
FIG. 5 is a flowchart of an example method performed by an electrophotographic printing device.

FIG. 5 shows an example method 500 that the electrophotographic printing device 100 performs. The photoconductive drum 102 of the printing device 100 is rotated (502). As the photoconductive drum 102 rotates, the following occurs. Colorant is transferred onto the media 116 from the photoconductive drum 102 (504). That is, the photoconductive drum 102's surface is charged by the charge roller 104, and selectively discharged by the discharge mechanism 106 in accordance with the image to be formed on the media 116. Colorant applied to the photoconductive drum 102 by the dispensing roller 108 in accordance with the image, and then transferred from the drum 102 to the media 116 via the transfer roller 112. Remaining colorant on the photoconductive drum 102 is removed by the sponge 202 using the cleaning solution (506), and the cleaning solution is wiped from the drum 102 by the wiper 204 as described (508), before the process is repeated at part 504 for another image.

We claim:

1. A cleaning assembly for a photoconductive drum of an electrophotographic printing device, comprising:

a sponge impregnated with a cleaning solution to at least substantially remove colorant from the photoconductive drum as the photoconductive drum rotates past the sponge; and a wiper having an edge that is to wipe the cleaning solution from the photoconductive drum and that is rounded at a selected radius to maintain a correspondingly defined layer of the cleaning solution on the photoconductive drum during wiping.

2. The cleaning assembly of claim 1, wherein the selected radius of the rounded edge is between 1.5 millimeters and 10.0 millimeters to maintain the correspondingly defined layer of the cleaning solution on the photoconductive drum at a thickness greater than 100 nanometers during wiping.

3. The cleaning assembly of claim 1, wherein the selected radius of the rounded edge is about 1.5 millimeters to maintain the correspondingly defined layer of the cleaning solution on the photoconductive drum at a thickness of about 300 nanometers during wiping.

4. The cleaning assembly of claim 1, wherein the selected radius of the rounded edge of the wiper maintains the defined layer of the cleaning solution on the photoconductive drum at thickness greater than 100 nanometers during wiping.

5. The cleaning assembly of claim 1, wherein the wiper has a plurality of edges including the edge, each edge being rounded, the wiper removably positionable in relation to the photoconductive drum to permit the wiper to be periodically repositioned so that a different edge that is rounded is closest to the photoconductive drum.

6. The cleaning assembly of claim 1, wherein the cleaning solution is an isoparaffinic fluid.

7. An electrophotographic printing device comprising:

a photoconductive cylinder;

a cleaning mechanism to at least substantially remove colorant from the photoconductive cylinder as the photoconductive cylinder rotates past the cleaning mechanism by using a cleaning fluid; and a wiping mechanism positioned after the cleaning mechanism with respect to a rotational direction of the photoconductive cylinder, the wiping mechanism having an edge closest to the photoconductive cylinder to wipe the cleaning fluid from the photoconductive cylinder, the edge being rounded at a selected radius to maintain a correspondingly defined layer of the cleaning fluid on the photoconductive cylinder during wiping.

8. The electrophotographic printing device of claim 7, wherein the selected radius of the rounded edge is between 1.5 millimeters and 10.0 millimeters to maintain the correspondingly defined layer of the cleaning solution on the photoconductive drum at a thickness greater than 100 nanometers during wiping.

9. The electrophotographic printing device of claim 7, wherein the selected radius of the rounded edge is about 1.5 millimeters to maintain the correspondingly defined layer of the cleaning solution on the photoconductive drum at a thickness of about 300 nanometers during wiping.

10. The electrophotographic printing device of claim 7, wherein the selected radius of the rounded edge of the wiper maintains the correspondingly defined layer of the cleaning fluid on the photoconductive cylinder during wiping at a thickness greater than 100 nanometers.

11. The electrophotographic printing device of claim 7, further comprising:

a charging mechanism positioned after the wiping mechanism with respect to the rotational direction of the photoconductive cylinder, the charging mechanism to pre-charge the photoconductive cylinder with an electrical charge after the wiping mechanism wipes the photoconductive cylinder.

12. The electrophotographic printing device of claim 7, wherein the wiping mechanism has a plurality of edges including the edge closest to the photoconductive cylinder, each edge being non-nominally sharp, the wiper removably positioned in relation to the photoconductive cylinder to permit the wiper to be periodically repositioned so that a different edge that is non-nominally sharp is closest to the photoconductive cylinder.

13. The electrophotographic printing device of claim 7, wherein photoconductive cylinder is an amorphous silicon photoconductive cylinder.

14. A method comprising:

rotating a photoconductive drum;

selectively transferring colorant from the photoconductive drum onto media to form a specified image on the media;

at least substantially removing the colorant that remains on the photoconductive drum after selective transfer thereof onto the media by using a cleaning solution; and wiping the cleaning solution from the photoconductive drum after removing the colorant from the photoconductive drum by passing the conductive drum past a wiper having an edge that is rounded at a selected radius to maintain a correspondingly defined layer of the cleaning solution on the photoconductive drum during wiping.

15. The method of claim 14, wherein the selected radius of the rounded edge is between 1.5 millimeters and 10.0 millimeters to maintain the correspondingly defined layer of the cleaning solution on the photoconductive drum at a thickness greater than 100 nanometers during wiping.

16. The method of claim 14, wherein the selected radius of the rounded edge is about 1.5 millimeters to maintain the correspondingly defined layer of the cleaning solution on the photoconductive drum at a thickness of about 300 nanometers during wiping.

17. The method of claim 14, wherein the selected radius of the rounded edge maintains the correspondingly defined layer of the cleaning fluid on the photoconductive cylinder during wiping at a thickness greater than 100 nanometers.

* * * * *